US005600407A

United States Patent [19]

Kasiske et al.

[11] Patent Number: 5,600,407

[45] Date of Patent: Feb. 4, 1997

[54] IMAGE FORMING METHOD AND APPARATUS FORMING COMBINED TONER IMAGES

[75] Inventors: W. Charles Kasiske, Penfield; Anne F. Lairmore, Hilton, both of N.Y.

[73] Assignee: Eastman Kodak Company, Rochester, N.Y.

[21] Appl. No.: 381,455

[22] Filed: Jan. 31, 1995

[51] Int. Cl.[6] ..... G03G 15/01

[52] U.S. Cl. ..... 399/56; 399/72

[58] Field of Search ..... 355/208, 228, 355/239, 246, 326 R

[56] References Cited

U.S. PATENT DOCUMENTS 4,821,065 4/1989 Ishii et al. ..... 355/208 X 5,142,337 8/1992 Karidis et al. ..... 355/326 R 5,298,944 3/1994 Sawayama et al. ..... 355/208

*Primary Examiner*—Nestor R. Ramirez

*Attorney, Agent, or Firm*—Leonard W. Treash, Jr.

[57] ABSTRACT

An image forming method and apparatus creates two toner images on a single portion of an image member. The first toner image formed has multiple density levels. It is recharged before creating the second toner image. An aspect of the potential associated with the toner in the first toner image after the recharge step is monitored and used to control the process, for example, by setting a development bias on a development station used to tone the second toner image or by controlling the recharging step.

15 Claims, 6 Drawing Sheets

IMAGE FORMING METHOD AND APPARATUS FORMING COMBINED TONER IMAGES

BACKGROUND OF THE INVENTION

This invention relates to the formation of toner images on an image member. Although not limited thereto, the invention is particularly useful in a method and apparatus for forming two or more different color toner images on a single frame of an image member.

U.S. Pat. No. 5,001,028 to Mosehauer et al is representative of a number of references describing a process in which a photoconductive image member is uniformly charged and imagewise exposed to create an electrostatic image. Dry toner is applied to the electrostatic image to create a toner image. Usually in this process, discharged area development is used. Thus, the toner applied is of the same polarity as the electrostatic image. Deposits in the areas of lowest charge (the discharged areas) form a toner image having a density which is greatest in the portions of the image receiving the greatest exposure. Without fixing the first toner image, the image member is usually uniformly charged, again with a charge of the same polarity as the original image and imagewise exposed to form a second electrostatic image generally in the portions of the image member not covered by the first toner image. The second electrostatic image is toned, again with a toner of the same polarity as the electrostatic image but of a color different from the first toner image, to create a second toner image. The process can be repeated with a third electrostatic image toned by a third color toner to create a three color image, etc. The two (or more) color images all have the same polarity and are easily transferred in a single step to a receiving sheet and fused, also in a single step.

Although the process is not necessarily limited to such applications, it is most commonly used to provide accent color prints or copies with laser or LED printhead electronic exposure. All commercial applications known to me use electronic exposure and discharged area development.

The process has a number of advantages in multiple color applications. It eliminates the troublesome, inaccurate and/or expensive steps used in registering images at a transfer station. If it uses separate exposure stations for each image, it can produce multiple color output at the same speed as single color output.

It is important that the second and subsequent toning steps not disturb the previous toner images. Otherwise, toner from the first toner image, unintentionally removed ("scavenged") from the PC, gets mixed into the second development station and toner from the second development station is deposited on the first toner image ("overtoning"). The relative seriousness of scavenging and overtoning is dependent upon the order of colors. In a system in which a lighter color is deposited first, and a darker color later, overtoning is more serious than scavenging. However, in a system in which a darker color, for example, black, is deposited first and the lighter color is deposited second, scavenging of the dark color into the light color toning station is a much more serious problem. (Overtoning could occur as a result of scavenging with the second color replacing the scavenged first color toner.)

Scavenging can be greatly reduced by using projection toning for toning the second and subsequent electrostatic images. For greatest deposition of toner using projection toning, an AC signal is applied to the toning field; see, for example, U.S. Pat. No. 4,803,518 to Haneda et al, granted Feb. 7, 1989 and, particularly, U.S. patent application Ser. No. 07/065,249, filed May 20, 1993 to Kaukeinen et al, entitled IMAGE FORMING METHOD AND APPARATUS and other references referred to therein.

Whether or not an AC signal is used, a DC component ($V_{b'}$) of the development field in the second development step is an important parameter in controlling the process. U.S. Pat. No. 4,860,048 to Itoh et al, issued Aug. 22, 1989, suggests using an electrometer to examine toner voltages in a binary system. The voltage readouts can be used to adjust $V_{b'}$ and also the second charging (sometimes called "recharging") step. The electrometer is positioned after the second exposure step and appears to examine the image, apparently isolating the voltage on the toner from the rest of the first toner image. This is then used to adjust $V_{b'}$ to prevent toning of either the background or the first toner image.

Other references suggest careful control of the recharging step, also in binary systems, to prevent scavenging and overtoning; see, for example, U.S. Pat. No. 4,611,901 to Kohyama et al, issued Sep. 16, 1986; U.S. Pat. No. 4,819,028 to Abe, issued Apr. 4, 1989; and U.S. Pat. No. 4,927,724 to Yamamoto et al, issued May 22, 1990.

U.S. Pat. No. 5,182,599 to Kinoshita, issued Jan. 26, 1993, suggests forming a conventional process control patch whose density is read for control of toner concentration, developer bias and charging in a multicolor, single frame system.

U.S. Pat. No. 5,208,632 to Hurwitch et al, issued May 4, 1993, uses a pair of electrometers to read six electrostatic patches for control decisions in a single exposure accent color system.

SUMMARY OF THE INVENTION

In most of the prior an mentioned above, the imaging is binary. That is, at a single pixel level, there is either toner of a given density or there is no toner.

It is known that higher image quality can be obtained by varying the density of individual pixels. For example, a "four bit" system might have 15 levels of density plus background in its toner image. A "two bit" system might have three levels of density plus background. Such "gray level" imaging systems are known in the literature but are not as yet common in practice. In producing multicolor images on a single frame, as described in most of the above patents, we found that the multiple levels of density created particular problems of control of the system not present with binary systems.

For example, we have found that the recharging step does not create an even amount of charge across varying height toner stacks and the effects, especially of overtoning, vary according to the height (density) of the stack in the first image.

It is an object of the invention to control the problems of scavenging, overtoning and background development in such "gray level" systems utilizing varying density toner imaging.

This and other objects are accomplished by a method of forming at least two toner images on a portion of an image member. The method includes forming a first electrostatic image on the portion, which electrostatic image has a plurality of voltage levels, applying a first toner to the first electrostatic image to form a first toner image having a plurality of differing toner densities (in addition to any background), applying a charge to said portion of the image member, including a charge to the first toner image, imagewise exposing the charged image member to create a second electrostatic image in registration with the first electrostatic image and applying a second toner to the second electrostatic image to form a second toner image in said portion. A potential associated with at least one of the densities of the first toner image after the charging step is monitored and the process is adjusted in response to such monitored potential.

According to a preferred embodiment, the method is particularly characterized by the steps of forming an electrostatic reference patch outside of the first electrostatic image on the image member, applying the first toner to the electrostatic patch to form a toner patch, applying a charge to the toner patch associated with applying a charge to the first toner image and monitoring a potential associated with the toner patch after the charge is applied to it and adjusting the process in response to said monitored potential.

According to another preferred embodiment, the step of applying a second toner to the second electrostatic image is accomplished in the presence of an electric field having a DC component (sometimes called "bias") $V_b$, and the step of adjusting the process in response to the monitored voltage includes the substep of setting the said DC component in response to the monitored voltage. The electric field in the second toning step preferably also includes an AC signal which is especially helpful in maintaining intensity if projection toning is used.

According to another preferred embodiment, the step of adjusting the process in response to the monitored voltage includes adjusting the level of charge applied in the charge applying step.

According to another preferred embodiment, the step of forming the electrostatic reference patch includes forming an electrostatic reference patch having a voltage which is in between the highest and lowest voltages in the first electrostatic image. This creates a toner patch having a density greater than zero and below the highest density. We have found that, in fact, the patch can be picked to be the density above which some overtoning can be tolerated and then $V_b$, made equal to the monitored voltage. With these preferred embodiments, the direct current portion of the development field is set to prevent overtoning of the lightest densities in the first image but to permit some overtoning in the darkest densities, thereby reducing scavenging. Whatever the actual optimization, the use of the patch allows adjustment according to the voltage distribution among various height toner stacks. It, thereby, allows more accurate control of the tradeoff between overtoning, scavenging and background toning in development of the second (and subsequent) images.

DETAILED DESCRIPTION OF THE INVENTION

Figure 1:
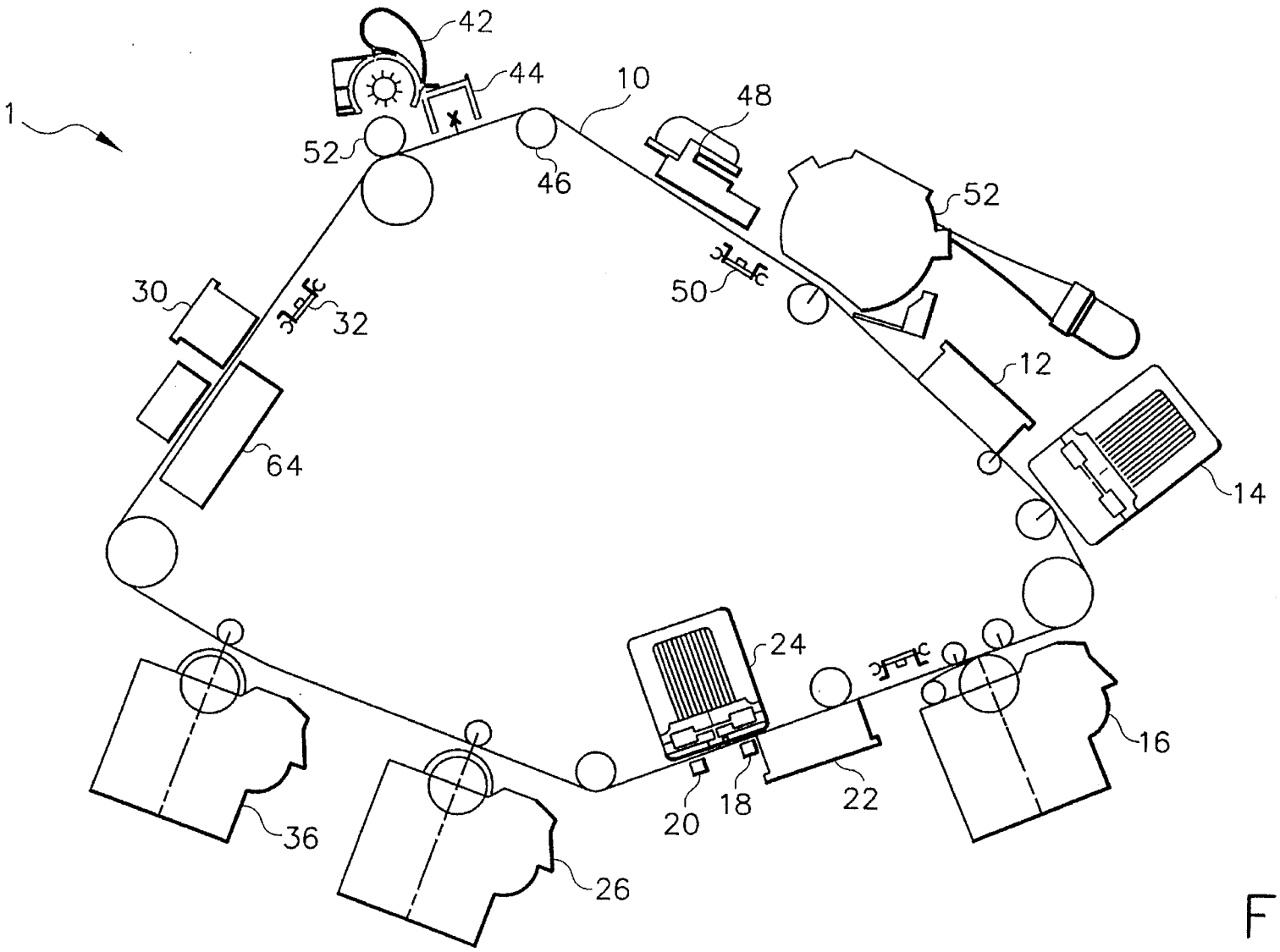
FIG. 1 is a side schematic of an image forming apparatus.

The method subsequently described can be carried out in a variety of ways with a variety of image forming apparatus. FIG. 1 is illustrative of one such apparatus.

According to FIG. 1, an image forming apparatus 1 includes an image member 10 trained about a series of rollers for movement through an endless path. Image member 10 is shown as a flexible belt which happens to be transparent and includes one or more photoconductive layers. However, it can also be an opaque drum or a plate or other form of web. In the preferred embodiment, it is photoconductive so that it is useful in an electrophotographic process. However, the invention can be carried out in other electrostatic processes in which a photoconductor is not necessary. Therefore, although a photoconductive image member is preferred, it is not absolutely required.

As shown in FIG. 1, image member 10 is first uniformly charged at a first charging station 12 and imagewise exposed at an exposing station, for example, a first LED printhead 14, to create an electrostatic image. As will be discussed more thoroughly below, the electrostatic image has a plurality of levels of potential as controlled by first printhead 14 which exposes with a plurality of levels of intensity above zero (a gray scale exposure).

The first electrostatic image is toned by first toning station 16 which applies a finely divided toner of a first color, for example, black, to create a first toner image of the first color. Preferably, the toner is charged to the same polarity as the electrostatic image. Thus, it adheres to the discharged areas of the electrostatic image and its density is inversely proportional to the voltage in the electrostatic image and directly proportional to the exposure from first printhead 14. This type of development is called discharged area development (DAD). The image member is now recharged by a second charger 22 which attempts to, as much as possible, even the potential across the portion of the image containing the first toner image. The second charger 22 also applies a charge of the first polarity to the image member and is, thus, said to be "recharging" the image member. The recharged image member is, again, imagewise exposed at a second exposing station, for example, a second LED printhead 24 to create a second electrostatic image. This exposure can be binary, but is preferably a gray scale exposure.

The second electrostatic image is toned by the application of toner from one of second and third toning stations 26 and 36 to create a second toner image in the same portion containing the first toner image. If the second toner is of a different color than the first toner, a two color image is formed. Obviously, both toners could be of the same color but different in some other respect, for example, one of them could be responsive to a magnetic signal. For most purposes herein, it will be assumed that the two toners are of different colors. Ordinarily, stations 26 and 36 will have toners of different colors, giving the operator a choice of one color from station 16 and a second color from either station 26 or station 36.

This type of system is useful in producing what is commonly referred to as accent color images. Most imaging is done in black from station 16 but, for special accenting, a second color, which might be red in station 26 or yellow in station 36, is used. Letterheads and logos are also commonly made with this approach. A transmission densitometer 64 is positioned to examine the image or conventional density patches for controlling the process.

A pretransfer corona 30 and a pretransfer erase 32 are positioned to prepare the image for transfer to a receiving sheet at a transfer station which includes a transfer backing roller 40, a cleaner 42 for the transfer backing roller and a separation corona 44. After the toner image has been transferred to the receiving sheet, the receiving sheet is separated from the image member 10 as the image member passes around a small roller 46 and is transported to a fuser, not shown, for fixing and ultimately to an output tray. The image member 10 is cleaned at a cleaning station 52 after being subjected to a preclean corona 48 and a preclean erase 50.

As mentioned above, printhead 14 has the capability of providing a high quality exposure to charged image member 10. That exposure can include many levels of intensity which create a variety of voltage levels in the electrostatic image. For example, a "four-bit" system would have 16 levels of exposure, including no exposure. When such an electrostatic image is toned at first toning station 16, 15 different densities of toner can be obtained in addition to zero density background. For the same resolution, this provides a much higher quality image than does a simple binary system in which a number of pixels must be used to obtain the effect of an intermediate level of density.

Figure 6:
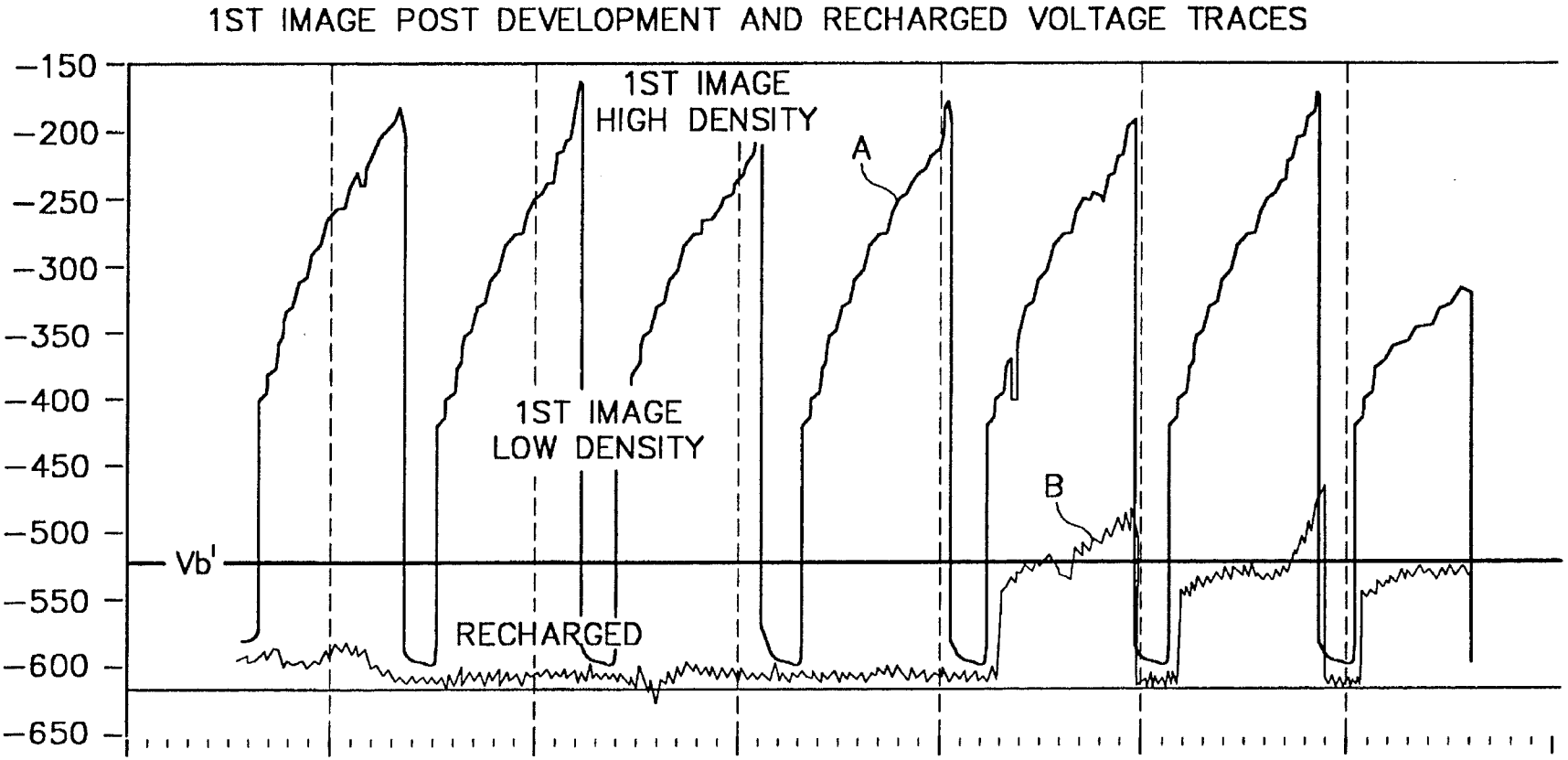
FIG. 6 is a reproduction of a trace of toner stack voltages before and after recharging.

The condition of the first toner image prior to recharging by second charging station 22 is a function of a number of parameters of the system, including the characteristics of the first toner. Referring to FIG. 6, a voltage trace was run of a 16 level toner image before and after recharging. The original charge $V_z$ on the image member was about −600 volts. The recharging step brought the bare image image member to a charge $V_{z'}$ of −625 volts. The higher and more solid line A represents the voltage on the toner stack immediately after development and before recharging. Note that with the toner in question, the voltage $V_t$ varied from around −400 to −175 volts across the various levels of the image with the 175 volt portion being the highest stackheights or the highest density portions of the image and the 400 volts being the lightest portion with some density. The image member itself remained charged to around 600 volts. This is the sixteenth level and represents the background.

A second trace, designated B in FIG. 6, shows the voltage $V_{t'}$ across the image after recharging using second charger 22. Because of the positioning of the electrometers in the test, the first trace of an actual recharge of a toner image is at the designation B. Note that the recharge does not totally bring the toner stacks to the same level $V_{z'}$ as the base image member and that the toner recharge varies according to the height of the toner stack. This result might be explained by the fact that the higher stacks had the lowest charge and, therefore, required the most new charge to return to the background level, which was not accomplished on a fast moving image member. The conductivity of the toner also appears to have an effect. Whatever its cause, this incomplete and variable recharge must be accounted for in the rest of the process, especially in toning the second electrostatic image.

Figure 2:
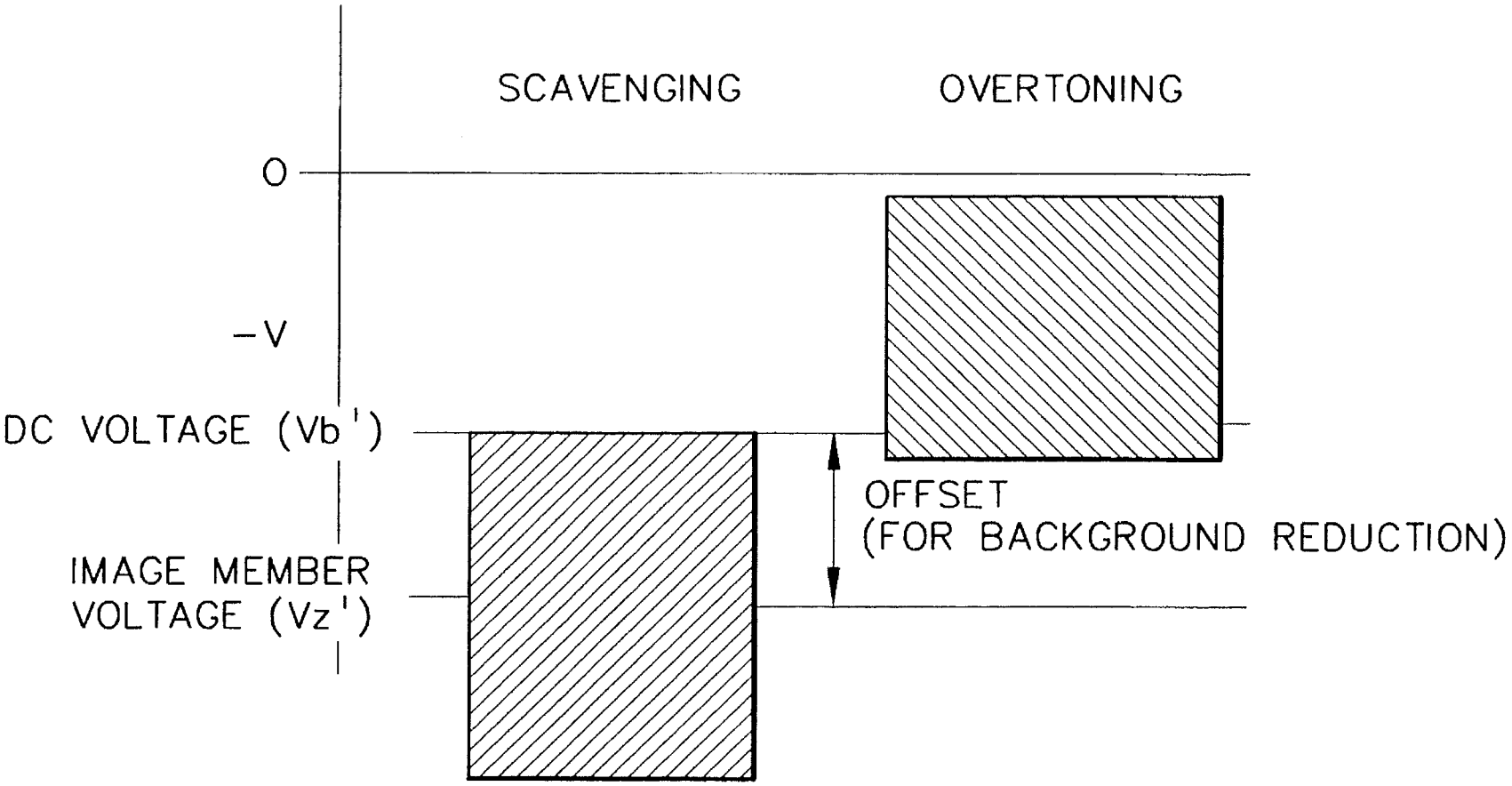
FIG. 2 is an illustration of conditions of scavenging and overtoning with respect to various parameters of an image forming system.

FIG. 2 shows an illustration of the tradeoff between overtoning, scavenging and background reduction in a two color system of this type. After the recharge step, the portion of the image member that does not have any toner is charged to the nominal voltage $V_{z'}$ (approximately −625 volts in FIG. 6). Because it is desirable to be sure that no toner ends up adhering to this portion of the image, the bias on the second development station $V_{b'}$ is offset from $V_{z'}$ by a safe margin, say, at least 50 to 65 volts. That is, $V_{b'}$ should not be higher (more negative) than −575 volts. (See discussion of FIG. 5 below.) This also has a good effect on overtoning. That is, the further from $V_{z'}$ that $V_{b'}$ is set, the less likely it is that the toner stacks from the first image will be overtoned with toner from the second station. However, it has an adverse effect on scavenging. The further from $V_{z'}$ that $V_{b'}$ is set, the greater the chance that toner from the first image will be attracted off the image into the second toning station. If the first toning station contains black toner and the second toning station contains yellow toner, any scavenging can create a serious problem. At the same time, overtoning of yellow onto black is not serious in the more dense portions of the first image.

Figure 3:
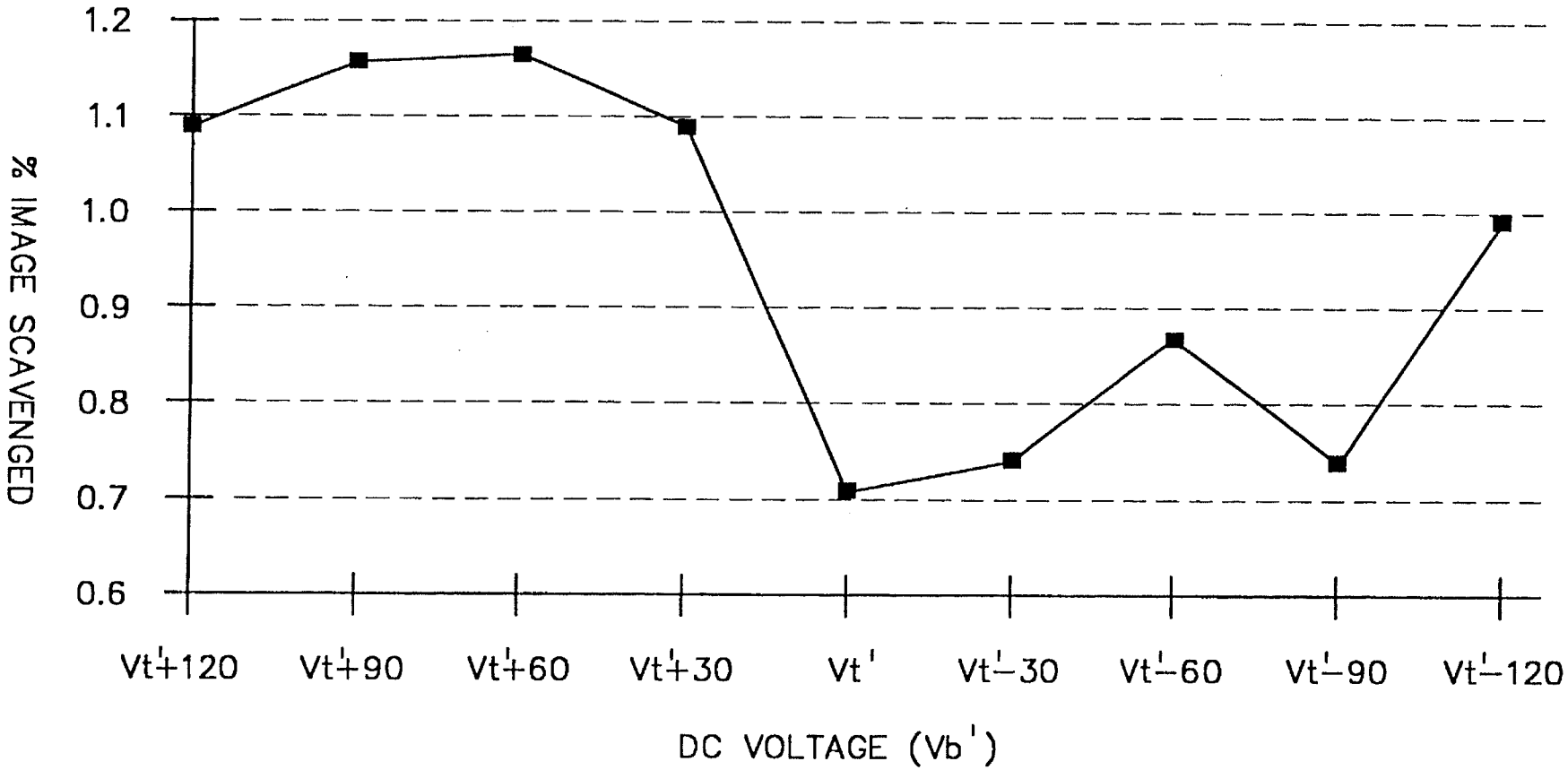
FIG. 3 is a graph of image scavenging against DC voltage for a second image toning step.

FIG. 3 illustrates the effect on scavenging of the placement of $V_{b'}$ in a projection toning system. Typical of projection toning systems, an AC bias is also used to improve density of development and other effects such as carrier carryout. Both the AC and DC bias can influence overtoning, scavenging, and background. The DC bias, however, will be emphasized herein. $V_{t'}$ is the voltage on a particular toner stack after recharging and $V_{b'}$ is shown in FIG. 3 with respect to $V_{t'}$. This data was collected using a napless toning station in which all scavenging is due to electrical field effects. Not surprisingly, if, in a negatively working system, $V_{b'}$ is placed more positive than the voltage of the toner stack, some scavenging of that stack occurs. The projection toning system is comparable to that described in U.S. patent application Ser. No. 08/065,249, referred to above. That application is hereby incorporated by reference herein.

Figure 4:
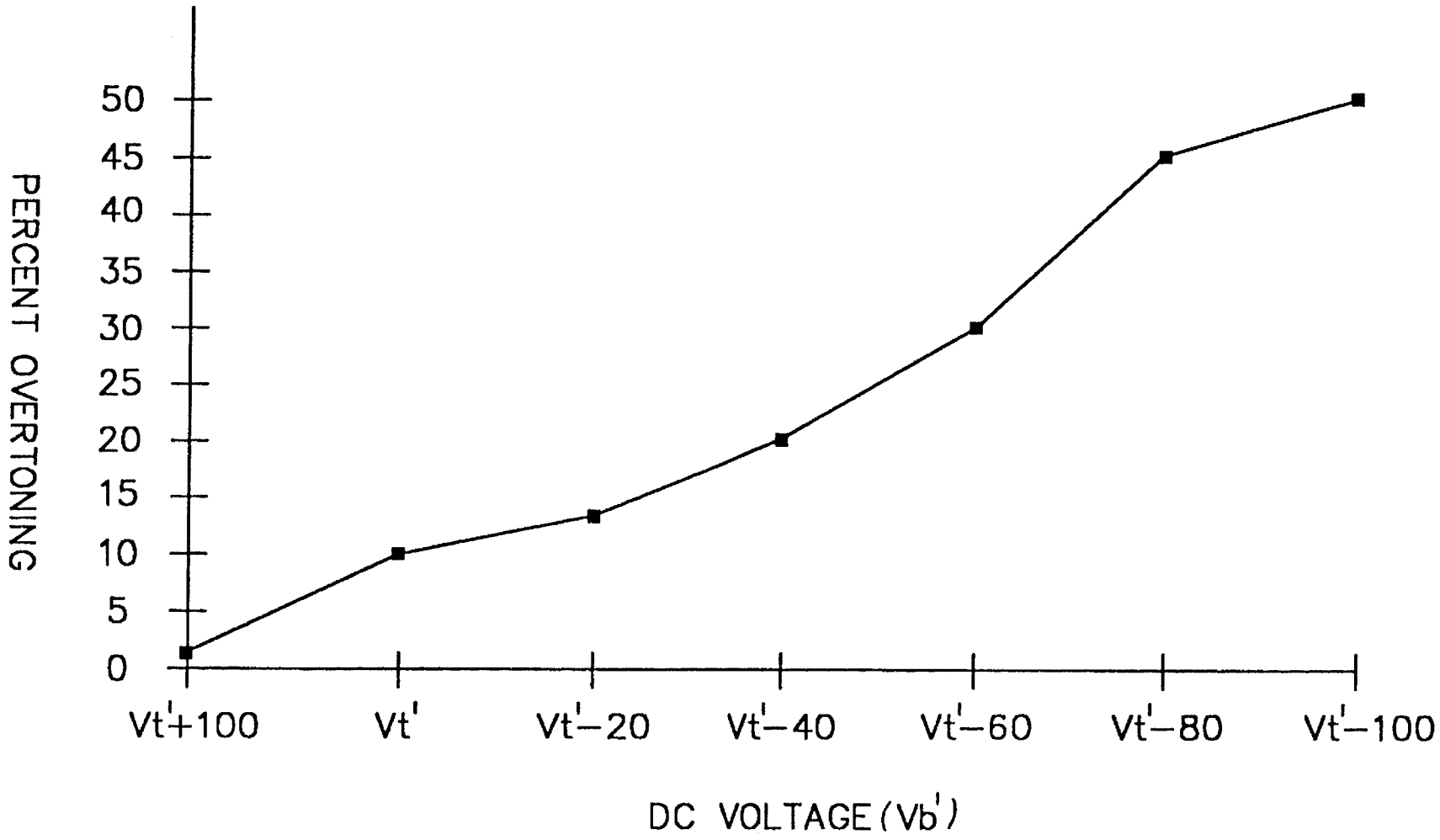
FIGS. 4 and 5 are graphs illustrating overtoning and background versus DC voltage, respectively, in a second image toning step.

FIG. 4 shows the effect of $V_{b'}$ on overtoning as a function of its difference from the toner stack voltage $V_{t'}$.

Figure 5:
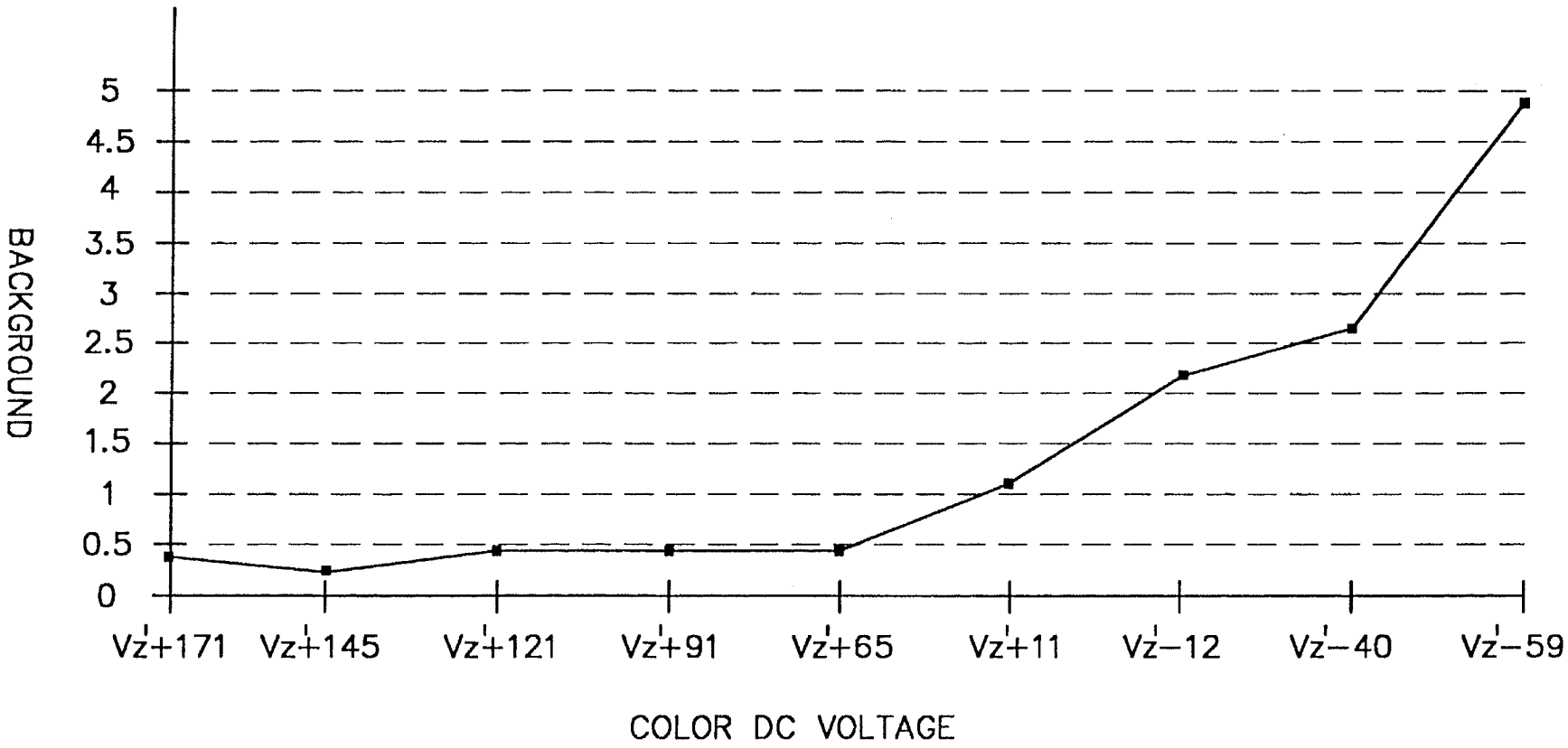

FIG. 5 illustrates the effect of $V_{b'}$ (as measured by the difference from $V_{z'}$) on background toning. Note that substantial background begins to occur in this particular system when the difference between the two voltages gets less than 65 volts.

Thus, the bias on the development station must be set to consider all three effects, background, overtoning and scavenging. The greater the difference between the development station bias and the image member voltage ($V_{b'}$ and $V_{z'}$) the less the effects of background and overtoning. However, some overtoning can be tolerated in the more dense portions of the first image, especially if its color is darker than the second image. As seen from FIG. 4, the effect of overtoning is a direct function of the difference between $V_{b'}$ and $V_{t'}$.

For best results, it is preferable to allow a small amount of overtoning in the more dense portions of the first image but prevent them in the less dense portions. This somewhat reduces the difference between $V_{b'}$ and $V_{z'}$ as compared with trying to eliminate overtoning altogether. It has the great advantage of reducing scavenging.

This is accomplished and controlled by determining the toner stack voltage of an intermediate level stack after recharging, as shown in FIG. 6. For example, in a 15 level (plus background) gray scale system, $V_{b'}$ is picked to approximate a level allowing overtoning of the most dense three levels of the first image and inhibiting overtoning of the less dense twelve levels of the first image. As compared to placing $V_{b'}$ at the most dense portion, this would provide considerably less scavenging. It allows some overtoning, but only of the most dense portions.

To control the process best, the stack potential of an intermediate level stack after recharging is monitored. This can be done by attempting to measure it as part of the image with relatively complicated image analysis electronics. However, especially with a gray scale image it is preferable to lay down an intermediate potential patch as part of the formation of the first electrostatic image by the first exposure station 14. The patch should be .outside the first image but near it. For example, conventional process, control patches are often formed in the interframe between images. That patch is then toned to an intermediate density level and its potential measured by an electrometer 18 positioned immediately after the recharging charger 22 or an electrometer 20 positioned immediately after the second exposure (which does not expose this particular patch). Either of these electrometers will provide a potential indicative of a particular intermediate toner stack voltage $V_t$, after recharge. As that potential varies because of varying parameters in the system, the process is adjusted accordingly. For example, the bias $V_{b'}$ is varied to correspond to the monitored potential. Obviously, the two potentials need not be identical since the bias can be set a particular number of volts above or below the voltage of the particular stack height measured. However, preferably, the amount of exposure for the patch should be picked to create a toner density that provides a potential after recharge that is as close to the desired $V_{b'}$ as possible.

The adjustment step can also use the monitored potential of the patch to control the recharge step in the process. That is, charger 22 can be adjustable to lay down different level of charge. $V_{b'}$ can be allowed to be relatively fixed (or used to control another variable) and the charger 22 adjusted until the $V_t$, of the patch has a predetermined relation with the fixed $V_{b'}$. Obviously, the two controls could both be varied in the same system according to the monitored toner stack voltage $V_t$.

The monitor and adjust steps can be done for every image or at some less frequent period. Preferably, it is coordinated with any other process control in the apparatus.

Although greatest control is obtained if the monitored toner stack is an intermediate one, some control could be obtained by monitoring the highest density portion of the image and estimating an offset from it for setting $V_{b'}$ to permit some overtoning. Although the invention is designed for apparatus doing gray scale exposure at both printheads, it clearly can be used equally as well when the second exposure is binary.

The invention has been described in detail with particular reference to a preferred embodiment thereof, but it will be understood that variations and modifications can be effected within the spirit and scope of the invention as described hereinabove and as defined in the appended claims.

We claim:

1. A method of forming at least two toner images on a portion of an image member, said method comprising:

applying a charge of a first polarity to an electrophotographic image member, imagewise exposing a portion of the electrophotographic image member to a first pattern of radiation having a plurality of intensities greater than zero to form a first electrostatic image having a plurality of potential levels, all of the first polarity, applying a first toner having a charge of the first polarity to the first electrostatic image to form a first toner image on said portion, said toner image having a plurality of density levels including an intermediate density level less than the highest density level, in addition to any zero density level, recharging the portion of the image member by applying a charge of the first polarity to said portion of the image member, including applying such a charge to the first toner image, imagewise exposing the recharged portion to create a second electrostatic image in registration with the first toner image, applying a second toner having a charge of the first polarity to the second electrostatic image to form a second toner image in registration with said first toner image, and monitoring a potential associated with the intermediate density level toner of the first toner image after the recharging step and adjusting the process in response to said monitored potential.

2. A method according to claim 1 wherein the step of applying a second toner includes creating an electric field to control the toning process, which field has a DC bias associated with it having a level which affects clarity of background, scavenging and overtoning in the step of applying a second toner, and wherein said step of adjusting the process includes adjusting the value of the DC bias of the electric field in response to said monitored potential.

3. The method according to claim 2 wherein said DC bias is of the first polarity and of a magnitude greater than the potential on the most dense portion of the first toner image after the recharging step.

4. The method according to claim 3 wherein said DC bias is of a magnitude less than the potential on toner present in some density levels of the first toner image after the recharging step.

5. The method according to claim 1 wherein said step of exposing to create a first electrostatic image includes exposing said portion of the image member to at least a high, an intermediate and a low intensity level of radiation and wherein the step of applying a first toner to the first electrostatic image includes applying a high amount of toner to the portion receiving the high level of exposure and an intermediate amount of toner to the portion receiving an intermediate amount of exposure and wherein the step of adjusting includes setting the DC component for the step of applying a second toner at a level equal to the potential associated with the portion of the first image having the intermediate density of toner after the recharging step.

6. The method according to claim 1 wherein the step of adjusting the process includes the substep of adjusting the charge applied in the recharging step in response to said monitored potential.

7. The method according to claim 1 wherein the first and second toners are of different colors.

8. The method according to claim 1 wherein the step of imagewise exposing to a first pattern includes exposing a reference patch of the charged image member with an intensity between the greatest and least of the plurality of intensities and the step of applying a first toner includes applying toner to the reference patch to a density between the greatest and least density level in the first toner image and wherein the step of monitoring includes monitoring the potential of the toner in the reference patch.

9. A method of forming at least two toner images on a portion of an electrophotographic image member, said method comprising:

uniformly charging the image member to a charge of a first polarity, imagewise exposing an image portion of the image member to radiation having at least a high level, an intermediate level and a zero or low level to create a first electrostatic image having at least a low potential, an intermediate potential and a high potential, applying a first toner of the first polarity to the first electrostatic image to form a first toner image having at least high and intermediate levels of toner corresponding to the portions of the electrostatic image having low and intermediate potentials, forming an electrostatic reference patch by exposing said image member in a location outside of the image portion to a level of radiation equal to the intermediate level of said imagewise exposure, applying the first toner also to the electrostatic reference patch to form a toner reference patch having a density approximating that of the intermediate level of toner portion of the first toner image, recharging the image member by applying a charge of said first polarity to both said image portion and said reference patch, including applying a charge to the toner thereon, imagewise exposing the recharged image member to create a second electrostatic image in registration with the first toner image, applying a second toner to the second electrostatic image to form a second toner image in said portion, monitoring a potential associated with the reference patch after it has been recharged, and adjusting the process in response to said monitored potential.

10. The method according to claim 9 wherein said step of applying a second toner includes the establishment of a bias associated with a toner station used to apply said second toner and wherein said step of adjusting the process includes establishing that bias in response to said monitored potential.

11. The method according to claim 10 wherein said bias is adjusted to be equal to the monitored potential.

12. The method according to claim 9 wherein said adjusting step includes adjusting the recharging step to adjust the monitored potential toward a desired nominal value.

13. A method of forming at least two toner images in registration on a portion of an image member, said method comprising:

applying a charge of a first polarity to an electrophotographic image member, imagewise exposing a portion of the image member to a first pattern of radiation having a plurality of differing intensities greater than zero to form a first electrostatic image having a plurality of potential levels of the first polarity, applying a first toner having a charge of the first polarity to the first electrostatic image to form a first toner image on said portion, said toner image having a plurality of different density levels in addition to any zero density level, recharging the portion of the image member by applying a charge of the first polarity to said portion of the image member, including applying such a charge to the first toner image, imagewise exposing the recharged portion to create a second electrostatic image in registration with the first toner image, using a toner applying device, applying a second toner having a charge of the first polarity to the second electrostatic image to form a second toner image in registration with the first toner image, applying a bias to the toner applying device to create an electric field to control the application of the second toner to the second electrostatic image, which bias has a DC component chosen to inhibit deposition of toner in unexposed portions of the second electrostatic image but to encourage deposition of the toner in exposed portions of the second electrostatic image, monitoring a potential associated with one of the levels of density of the first toner image after the recharging step, and adjusting the DC component of the bias applied to the toning device in response to said monitored potential to permit some overtoning of the most dense levels of the first toner image while inhibiting overtoning of less dense levels of the first toner image and inhibiting scavenging of the first toner image into the toning device.

14. Image forming apparatus for forming two toner images on a portion of a photoconductive image member, said apparatus comprising:

first means for charging the image member to a charge of a first polarity, first means for imagewise exposing the charged image member to a first pattern of radiation having a plurality of different intensities greater than zero to form a first electrostatic image having a plurality of potential levels of the first polarity, first means for applying a first toner having a charge of the first polarity to the first electrostatic image to form a first toner image on said portion, said toner image having a plurality of different density levels in addition to any zero density level, second charging means for recharging the portion of the image member by application of a charge of the first polarity to said portion of the image member including to the first toner image, second means for imagewise exposing the recharged portion to create a second electrostatic image in registration with the first toner image, second means for applying toner different from the toner applied by the first means and having a charge of the first polarity to the second electrostatic image to form a second toner image in registration with the first toner image, means for applying a bias to the second means for applying toner to create an electric field to control the application of the second toner to the second electrostatic image, which bias has a DC component chosen to inhibit deposition of toner in unexposed portions of the second electrostatic image but to encourage deposition of the toner in exposed portions of the second electrostatic image, means for monitoring a potential associated with one of the levels of density of the first toner image after said toner image has passed the second charging means, and means for adjusting said DC component of the bias in response to said monitored potential.

15. Image forming apparatus according to claim 14 wherein said first means for exposing includes means for exposing a patch outside of the portion to an intensity of radiation in between the highest and lowest radiation intensities forming the first electrostatic image, which patch is positioned to receive toner from the first toner applying means and wherein the means for monitoring is positioned to monitor the potential of the toned patch.

* * * * *